US005983058A

United States Patent [19]

Yamasaki et al.

[11] Patent Number: 5,983,058

[45] Date of Patent: Nov. 9, 1999

[54] METHOD AND APPARATUS FOR DEPOSITING INK ON AN IMAGE CARRYING MEMBER UTILIZED TO TRANSFER IMAGES TO A RECORDING MEDIUM

[75] Inventors: Hiroyuki Yamasaki, Amagasaki; Satoshi Deishi, Ibaraki, both of Japan

[73] Assignee: Minolta Co., Ltd, Osaka, Japan

[21] Appl. No.: 09/049,650

[22] Filed: Mar. 24, 1998

[30] Foreign Application Priority Data

Mar. 27, 1997 [JP] Japan ..... 9-074803
Nov. 19, 1997 [JP] Japan ..... 9-317814

[51] Int. Cl.[6] ..... G03G 15/10

[52] U.S. Cl. ..... 399/237; 430/117

[58] Field of Search ..... 399/237–239; 430/117–119

[56] References Cited

U.S. PATENT DOCUMENTS 4,272,599 6/1981 Moradzadeh .
5,572,274 11/1996 Lior et al. ..... 399/237 X

FOREIGN PATENT DOCUMENTS 7-271107 10/1995 Japan .
7-271198 10/1995 Japan .

*Primary Examiner*—William Royer
*Attorney, Agent, or Firm*—McDermott, Will & Emery

[57] ABSTRACT

In the present invention, in forming an electrostatic latent image on the surface of an image carrying member, holding ink in an ink carrying member in an ink developing device, and supplying the ink to the electrostatic latent image formed on the surface of the image carrying member, to form an ink image on the image carrying member, the critical surface tension on the surface of the image carrying member is larger than the surface tension of the ink.

20 Claims, 5 Drawing Sheets

METHOD AND APPARATUS FOR DEPOSITING INK ON AN IMAGE CARRYING MEMBER UTILIZED TO TRANSFER IMAGES TO A RECORDING MEDIUM

BACKGROUND OF THE INVENTION

This application is based on applications Nos. 74803/1997 and 317814/1997 filed in Japan, the contents of which is hereby incorporated by reference.

1. Field of the Invention

The present invention relates to an image forming apparatus and an image forming method in which ink is supplied to an electrostatic latent image formed on an image carrying member, to form an ink image on the image carrying member, and the ink image is transferred to a recording medium, to form an image on the recording medium.

2. Description of the Related Art

Conventionally, a copying machine, a printer, and so on utilizing an electrophotographic system have been used as an image forming apparatus. In such an image forming apparatus, an electrostatic latent image is formed on the surface of an image carrying member, and the electrostatic latent image is developed, and is then transferred to a recording medium such as paper, to form an image on the recording medium.

Known as one of such an electrophotographic image forming apparatus is one using a liquid developer obtained by dispersing colored resin particles (toner particles) in a carrier liquid in order to develop an electrostatic latent image formed on an image carrying member.

The electrophotographic image forming apparatus using such a liquid developer is superior in resolution or the like. On the other hand, an image having a sufficient image density is not obtained on a recording medium, and toner particles also adhere on a portion, which has no electrostatic latent image formed thereon, of an image carrying member, so that an image formed on the recording medium is fogged.

Conventionally, an image forming apparatus is constructed so that a dielectric liquid is applied to the surface of an image carrying member, and an electrostatic latent image is formed on the surface of the image carrying member, ink is brought into contact with the surface of the image carrying member having the electrostatic latent image thus formed thereon, the ink is made to adhere to a portion of the electrostatic latent image formed on the surface of the image carrying member, to form an ink image corresponding to the electrostatic latent image on the surface of the image carrying member, and the ink image is transferred onto a recording medium such as paper, an OHP sheet, or the like from the surface of the image carrying member, to form an image has been proposed, as disclosed in U.S. Pat. No. 4,272,599.

In the image forming apparatus, however, the ink does not sufficiently adhere on the portion of the electrostatic latent image formed on the surface of the image carrying member. Therefore, there are some problems. For example, the density of the formed image is decreased, and voids are created in the formed image. Contrary to this, the ink also adheres to a portion having no electrostatic latent image formed thereon in the image carrying member, so that the formed image is fogged.

SUMMARY OF THE INVENTION

An object of the present invention is to make, in supplying ink to an electrostatic latent image formed on the surface of an image carrying member to form an ink image, ink suitably adhere to a portion of the electrostatic latent image formed on the surface of the image carrying member, while adhering to a portion having no electrostatic latent image formed thereon.

Another object of the present invention is to stably obtain an image having a sufficient image density and having no voids and fog.

In a first image forming apparatus and a first image forming method according to the present invention, an electrostatic latent image is formed on the surface of an image carrying member, and ink is held on an ink carrying member provided on an ink developing device. In supplying the ink held in the ink carrying member to the electrostatic latent image formed on the surface of the image carrying member, to form an ink image on the image carrying member, the critical surface tension on the surface of the image carrying member is made larger than the surface tension of the ink. The ink image thus formed on the image carrying member is transferred onto a recording medium by a transfer device.

As in the first image forming apparatus and the image forming method according to the present invention, in a case where the image carrying member having larger critical surface tension on its surface than the surface tension of the ink is used, when the ink held on the surface of the ink carrying member is brought into contact with the surface of the image carrying member having the electrostatic latent image formed thereon to form an ink image corresponding to the electrostatic latent image, the ink is brought into contact with the surface of the image carrying member in a well spreading state, so that the ink is sufficiently supplied to a portion of the electrostatic latent image formed on the surface of the image carrying member.

The ink is thus sufficiently supplied to the surface of the image carrying member to form the ink image. As a result, when the ink image is transferred to the recording medium such as paper or an OHP sheet from the image carrying member, a good image having a sufficient image and having no voids and the like is obtained.

Letting $S_1$(dyn/cm) be the critical surface tension on the surface of the image carrying member, and $S_2$(dyn/cm) be the surface tension of the ink, the relationship satisfied by the difference therebetween $(S_1-S_2)$ is preferably $1 \leqq (S_1-S_2) \leqq 35$, more preferably $5 \leqq (S_1-S_2) \leqq 30$, and still more preferably $10 \leqq (S_1-S_2) \leqq 25$. When an image carrying member so constructed that a dielectric layer is provided on the surface of an electrically conductive member is used as the above-mentioned image carrying member, an example of the image carrying member is one whose critical surface tension $S_1$ on its surface is 21 to 55 dyn/cm, preferably 25 to 50 dyn/cm, and more preferably 30 to 45 dyn/cm.

When the image carrying member having the critical surface tension $S_1$ is used, an example of the ink corresponding thereto is one whose surface tension $S_2$ is 20 to 54 dyn/cm, preferably 20 to 45 dyn/cm, and more preferably 20 to 40 dyn/cm. The critical surface tension $S_1$ on the surface of the image carrying member and the surface tension $S_2$ of the ink are measured by a contact angle meter (CA-X Type: manufactured by Kyowa Kaimen Kagaku Co., Ltd.).

In a second image forming apparatus and a second image forming method according to the present invention, an electrostatic latent image is formed on the surface of an image carrying member, and a release agent is applied to the surface of an image carrying member by a release agent application device. Ink held on an ink carrying member provided in an ink developing device is brought into contact with the image carrying member, and the ink is supplied to the electrostatic latent image formed on the surface of the image carrying member, to form an ink image. Letting $T_K$ be a time period required for the ink to adhere on the surface of the image carrying member having the electrostatic latent image formed thereon through the release agent, $T_{NIP}$ be a time period elapsed from the time when the ink is brought into contact with the surface of the release agent on the image carrying member until it is separated therefrom, and $T_W$ be a time period required for the ink to adhere on the surface of the image carrying member having no electrostatic latent image formed thereon through the release agent, the relationship of $T_W > T_{NIP} > T_K$ is satisfied.

The time period $T_{NIP}$ elapsed from the time when the ink is brought into contact with the surface of the release agent on the image carrying member until it is separated therefrom is the nip width which is the distance from the position where the ink is brought into contact with the surface of the release agent applied to the image carrying member to the position where it is separated therefrom divided by the system speed which is the speed of movement of the image carrying member. The time period $T_K$ required for the ink to adhere on the surface of the image carrying member having the electrostatic latent image formed thereon through the release agent is the thickness of the non-conductive release agent applied to the surface of the image carrying member divided by the speed of movement at which the ink is moved in the release agent in a portion having the electrostatic latent image formed thereon. The time period $T_W$ required for the ink to adhere on the surface of the image carrying member having no electrostatic latent image formed thereon through the release agent is the thickness of the non-conductive release agent applied to the surface of the image carrying member divided by the speed of movement at which the ink is moved in the release agent in a portion having no electrostatic latent image formed thereon.

In satisfying the relationship of $T_W > T_{NIP} > T_K$ the nip width from the position where the ink is brought into contact with the surface of the release agent applied to the image carrying member to the position where it is separated therefrom and the speed of movement of the image carrying member are changed to adjust the value of $T_{NIP}$, and the type and the thickness of the non-conductive release agent applied to the surface of the image carrying member, the type of the ink, and the like are changed, to adjust the values of $T_K$ and $T_W$.

If the relationship of $T_W > T_{NIP} > T_K$ is thus satisfied, in bringing the ink into contact with the surface of the image carrying member having the electrostatic latent image formed thereon and coated with the release agent, to form the ink image on the surface of the image carrying member, the ink adheres on a portion of the electrostatic latent image formed on the surface of the image carrying member, while the ink is prevented from adhering on the portion having no electrostatic latent image formed thereon, so that a good image having a sufficient image density and having no voids and fog is stably obtained.

Furthermore, in order to further prevent the formed image from being fogged to ensure a more sufficient image density, the relationship to be satisfied is preferably $0.9\ T_W \geqq T_{NIP} \geqq 1.1\ T_K$, and more preferably $0.8\ T_W \geqq T_{NIP} \geqq 1.2\ T_K$.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
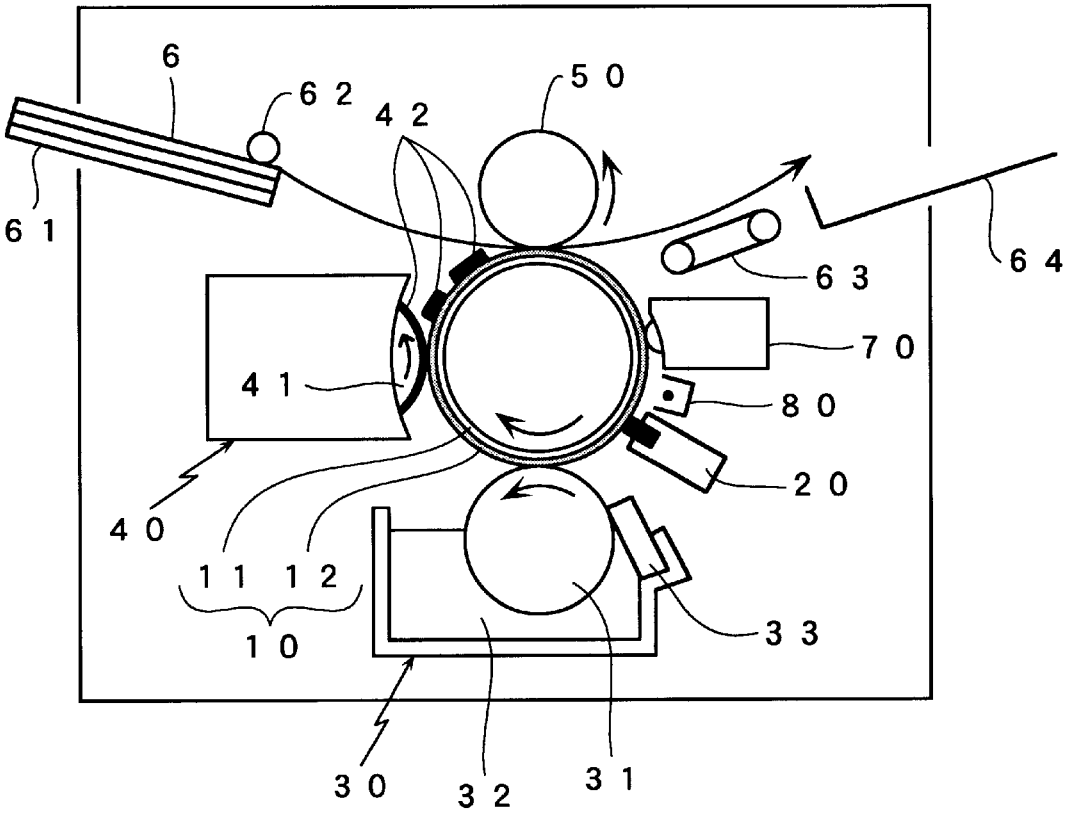
FIG. 1 is a schematic explanatory view of an image forming apparatus according to an embodiment 1 of the present invention.

Description is now made of preferred embodiments of the present invention.

Examples of an image carrying member used in the present invention include one so constructed that a dielectric layer is formed on the surface of an electrically conductive member and an electrophotographic photoreceptor so constructed that a photosensitive layer is formed on the surface of an electrically conductive member.

In the image carrying member, examples of a material composing the electrically conductive member include metals such as aluminum, iron, copper, nickel, SUS, gold, silver, chromium, platinum, tin, and titanium, and alloys of the metals, and resins having any of the conductive materials dispersed therein. In dispersing any of the conductive materials in the resin as described above, it is possible to use, as the resin, polyethylene, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, a polyurethane elastomer, polyamide, polyimide, etc.

Examples of a material composing the dielectric layer provided on the electrically conductive member include resins such as polyester, polypropylene, polyvinyl alcohol, polyvinyl acetate, an ethylene-vinyl acetate copolymer, polymethyl methacrylate, polycarbonate, polystyrene, an acrylonitrile-methyl acrylate copolymer, an acrylonitrile-butadiene-styrene copolymer, polyethylene terephthalate, polyurethane elastomer, viscose rayon, cellulose nitrate, cellulose acetate, cellulose triacetate, cellulose propionate, cellulose acetate butyrate, ethyl cellulose, regenerated cellulose, polyamide (nylon 6, nylon 66, nylon 11, nylon 12, nylon 46, etc.), polyimide, polysulfone, polyether sulfone, polyvinyl chloride, a vinyl chloride-vinyl acetate copolymer, polyvinylidene chloride, a vinylidene chloride-vinyl chloride copolymer, a vinyl nitrile rubber alloy, polytetrafluoroethylene, polychlorofluoroethylene, polyvinyl fluoride, and polyvinylidene fluoride, and inorganic materials composed of ceramics such as $Al_2O_3$, $SiO_2$, or $TiO_2$. It is also possible to use a combination of two or more types of dielectric materials.

As the photosensitive layer provided on the electrically conductive member, it is possible to use a photosensitive layer which is generally used in the electrophotographic photoreceptor.

In forming the electrostatic latent image on the image carrying member 10, when an image carrying member so constructed that a dielectric layer is formed on the surface of an electrically conductive member is used as the image carrying member, a discharger, an electrostatic head of an ion flow type, or the like for applying charge corresponding to an image to the dielectric layer on the surface of the image carrying member to form an electrostatic latent image is used. On the other hand, when a photoreceptor so constructed that a photosensitive layer is formed on the surface of an electrically conductive member is used as the image carrying member, a charger for charging the surface of the image carrying member and various types of exposing devices such as a laser device for exposing the charged surface of the image carrying member are used in combination.

Image forming apparatuses and image forming methods according to embodiments of the present invention will be specifically described on the basis of the accompanying drawings.

Embodiment 1

In the present embodiment 1, an image carrying member 10 so constructed that a dielectric layer 12 is formed on the surface of a cylindrical electrically conductive member 11 is used, as shown in FIG. 1. The image carrying member 10 is not limited to one in the above-mentioned cylindrical shape. Any image carrying member 10 so constructed that a dielectric layer 12 is formed on an electrically conductive member 11 may be used. For example, it may be one in a belt shape.

An electrostatic latent image is formed on the surface of the image carrying member 10 by a latent image forming device 20 while rotating the image carrying member 10.

In the present embodiment, as the latent image forming device 20, a discharge electrode 20 formed in a multi stylus shape is used. Discharges are selectively induced from the discharge electrode 20, to form an electrostatic latent image on the surface of the image carrying member 10. However, the latent image forming device 20 is not limited to the above-mentioned discharge electrode 20. Any latent image forming device so constructed that an electrostatic latent image can be formed by selectively charging the surface of the image carrying member 10 may be used.

In forming the electrostatic latent image on the surface of the image carrying member 10 by the latent image forming device 20 as described above, when the surface potential of the electrostatic latent image is low, ink 42 is not sufficiently supplied to the image carrying member 10, so that an image having a sufficient image density may not be obtained. Contrary to this, when the surface potential of the electrostatic latent image is too high, voids or the like may be created in a portion of a formed image. Therefore, it is preferable that the absolute value of the surface potential in a portion of the electrostatic latent image is in the range of 200 to 2000 V.

In the present embodiment, a release agent 32 is applied to the surface of the image carrying member 10 having the electrostatic latent image formed thereon as described above by a release agent application device 30, and the ink 42 is brought into contact with the surface of the image carrying member 10 thus coated with the release agent 32 to perform development by an ink developing device 40.

In the above-mentioned release agent application device 30, silicone oil 32 is used as the release agent 32, and a part of an application roller 31 is immersed in the silic one oil 32, to h old the silicone oil 32 on the surface of the application roller 31. The application roller 31 is rotated, and the amount of the silicone oil 32 on the surface of the application roller 31 is regulated by a regulating blade 33, to apply the silicone oil 32 to the surface of the image carrying member 10 having the electrostatic latent image formed thereon so as to have a suitable thickness from the application roller 31.

Although another known release agent can be also used in addition to the silicone oil as the release agent 32, it is preferable that the silicone oil is used from the viewpoint of facility for handling, for example.

In applying the release agent 32 to the surface of the image carrying member 10 having the electrostatic latent image formed thereon from the release agent application device 30, if the amount of application of the release agent 32 applied to the surface of the image carrying member 10 is small, the ink 42 is also supplied to a portion having no electrostatic latent image formed thereon, so that the formed image may be fogged in a case where the ink 42 is brought into contact with the surface of the image carrying member 10 to perform development by the ink developing device 40 as described later. Contrary to this, if the amount of application of the release agent 32 applied to the surface of the image carrying member 10 is too large, the ink 42 is not satisfactorily supplied to a portion having the electrostatic latent image formed thereon, so that the formed image may not be suitable because the density thereof is decreased, for example. When the release agent 32 is applied to the surface of the image carrying member 10, therefore, it is preferable that the thickness of the release agent 32 on the surface of the image carrying member 10 is in the range of 0.1 to 10 $\mu$m.

In supplying the i nk 4 2 from the ink developing device 40 to the surface of the image carrying member 10 coated with the release agent 32 composed of the silicone oil as described above, ink having smaller surface tension than the critical surface tension of the dielectric layer 12 on the surface of the image carrying member 10 is used as the ink 42, the ink 42 is held on the surface of an ink carrying member 41, and the thickness of the ink 42 on the surface of the ink carrying member 41 is adjusted by arbitrary means, which has been conventionally known, using a regulating blade or the like.

It is preferable that the thickness of the ink 42 on the surface of the ink carrying member 41 is so adjusted as to be in the range of 1 to 50 $\mu$m in order to prevent the ink 42 from being supplied to the portion having no electrostatic latent image formed thereon in the image carrying member 10 as well as to supply the ink 42 in sufficient amounts to the portion having the electrostatic latent image formed thereon.

When the ink 42 having smaller surface tension than the critical surface tension of the dielectric layer 12 on the surface of the image carrying member 10 is held on the ink carrying member 41 as described above, and the ink carrying member 41 is rotated, to bring the ink 42 held on the ink carrying member 41 into contact with the surface of the image carrying member 10 coated with the silicone oil 32, the ink 42 is brought into contact with the surface of the image carrying member 10 in a well spreading state, and the ink 42 is sufficiently supplied to a portion of the electrostatic latent image formed on the surface of the image carrying member 10, so that an ink image corresponding to the electrostatic latent image is formed on the surface of the image carrying member 10.

Any ink having smaller surface tension than the critical surface tension of the dielectric layer 12 on the surface of the image carrying member 10 as described above may be used as the ink 42 in the present embodiment. For example, ink 42 composed of a colorant, a vehicle, an additive added as required, and so on which is represented by ink for printing, for example, can be used. Lithographic ink used for lithographic printing out of various types of printing ink is preferably used, and oily ink is particularly preferable.

It is possible to use, as the colorant, various known colorants such as pigments. Examples of black pigments include carbon black. Examples of yellow pigments include yellow oxide. Examples of red pigments include lake red C, brilliant carmine 6B, rhodamine 6GPTMA toner, and red iron oxide. Examples of blue pigments include prussian blue, and cobalt blue.

It is possible to use, as the vehicle, oils, resins, solvents, plasticizers, etc. Examples of the oil include treated oils, mineral oils, etc. in addition to vegetable oils such as linseed oil and china wood oil. Examples of the resin include synthetic resins such as phenol resin modified by rosin, natural resins such as gilsonite, natural resin derivatives, etc. Examples of the solvent include high-boiling petroleum solvents such as tetradecane and pentadecane. Further, the plasticizer, for example, adipic acid ester, sebacic acid ester, paraffin chloride, etc. may be added as required.

Examples of the additive added as required to the ink 42 include waxes such as vegetable waxes, animal waxes, mineral waxes, and synthetic waxes, dryers such as metal soap and organic acids, surface-active agents such as lecithin and sorbitan fatty acid ester, and gelling agents such as hydrogenated castor oil and aluminum soap.

It is preferable that the electrical resistance of the ink 42 is high. Specifically, it is preferable that the volume resistivity thereof is not less than $1\times10^{8}$ ω·cm. Although the upper limit of the volume resistivity is not particularly limited, a volume resistivity of approximately $1\times10^{14}$ ω·cm is sufficient. It is preferable that the density of a solid content included in the ink 42 is approximately 30 to 50% by weight per the entire weight of the ink 42.

Although the details of the principle upon which when the ink 42 held on the ink carrying member 41 is brought into contact with the surface of the image carrying member 10 coated with the release agent 32 as described above, the ink 42 is not supplied to the portion having no electrostatic latent image formed thereon in the image carrying member 10, while being supplied to only the portion having the electrostatic latent image formed thereon are not clear, they are presumed as follows by the inventors and others of the present invention.

(1) A layer of the ink 42 held on the surface of the ink carrying member 41 first approaches the image carrying member 10 coated with the release agent 32, so that the layer of the ink 42 on the surface of the ink carrying member 41 is brought into contact with a layer of the release agent 32 on the surface of the image carrying member 10.

(2) In an image portion having the electrostatic latent image formed thereon, charge having a polarity opposite to the polarity of charge on the surface of the image carrying member is induced on the surface of the ink 42 through the layer of the release agent 32 on the image carrying member 10 by the charge on the surface of the image carrying member 10. Consequently, the layer of the ink 42 is drawn toward the image carrying member 10 upon receipt of an electrostatic attraction force, and is moved in such a manner as to put aside the layer of the release agent 32, to adhere on the surface of the image carrying member 10. In this case, only the colorant in the ink 42 is not moved, but the ink 42 is moved as a whole.

(3) When the ink carrying member 41 is separated from the image carrying member 10 so that the spacing therebetween exceeds a predetermined value, an adhesive force between the layer of the ink 42 in the image portion and the image carrying member 10 exceeds the cohesive force of the ink 42, so that the layer of the ink 42 is cut to predetermined thicknesses. The ink 42 is changed into an image upon remaining on the side of the image carrying member 10.

(4) On the other hand, the cohesive force of the layer of the ink 42 in a non-image portion having no electrostatic latent image formed thereon is larger than that of the layer of th e release agent 32 . When t he i nk carrying member 41 is separated from the image carrying member 10, therefore, the layer of the release agent 32 is cut to predetermined thicknesses, so that the layer of the ink 42 is returned to the ink carrying member 41 without being transferred to the image carrying member 10.

When the ink 42 whose surface tension is smaller than the critical surface tension of the dielectric layer 12 on the surface of the image carrying member 10 is used as described above, the ink 42 is brought into contact with the surface of the image carrying m ember 10 in a well spreading state as described above, the layer of the ink 42 reaches the image portion of the image carrying member 10, and an adhesive force between the layer of the ink 42 and the image carrying member 10 exceeds the cohesive force of the ink 42, so that the layer of the ink 42 is cut to predetermined thicknesses. The ink 42 is changed into an image up on remaining on the side of the image carrying member 10. On the other hand, in the non-image portion of the image carrying member 10, the cohesive force of the layer of the ink 42 is larger than that of the layer of the release agent 32, so that the layer of the release agent 32 is cut to predetermined thicknesses. The layer of the ink 42 is returned to the ink carrying member 41 without being transferred to the image carrying member 10. The ink 42 is hardly supplied to the portion having no electrostatic latent image formed thereon in the image carrying member 10, while being satisfactorily supplied to the portion having the electrostatic latent image formed thereon, so that an ink image is formed.

In thus supplying the ink 42 to the image carrying member 10 from the ink carrying member 41, to form the ink image corresponding to the electrostatic latent image, when the ink carrying member 41 is brought into contact with the image carrying member 10 in such a manner as to be pressed hard thereagainst, the formed image is liable to be fogged. Therefore, it is preferable that the ink carrying member 41 is brought into contact with the image carrying member 10 in such a manner that strong pressure is not applied thereto.

The ink image formed on the surface of the image carrying member 10 in the above-mentioned manner is then transferred to a recording medium 6 by a transfer device 50.

In the present embodiment, a transfer roller 50 is used as the transfer device 50, and transfer paper 6 such as plain paper is used as the recording medium 6.

In transferring the ink image formed on the surface of the image carrying member 10 onto the transfer paper 6 by the transfer roller 50, the transfer paper 6 contained in a paper feeding tray 61 is fed by a paper feeding roller 62, to introduce the transfer paper 6 into a portion between the image carrying member 10 having the ink image formed thereon as described above and the transfer roller 50, and the ink image formed on the surface of the image carrying member 10 is transferred onto the transfer paper 6 under pressure by the transfer roller 50.

The transfer paper 6 to which the ink image is thus transferred is conveyed by a conveying belt 63 and is discharged into a discharge tray 64, while the ink 42 remaining on the surface of the image carrying member 10 after the transfer is removed from the surface of the image carrying member 10 by a cleaning device 70. Thereafter, charge on the surface of the image carrying member 10 is eliminated by a charge eliminating device 80. The above-mentioned operations are repeated, to form an image.

As a result, it is possible to form a good image which has a sufficient image density and is not fogged on the transfer paper 6.

EXPERIMENTAL EXAMPLES 1 TO 3

In the experimental examples, used as the ink 42 was one having a viscosity of approximately 150,000 cP which is obtained by adding a viscosity adjustor (Ink Refresher : manufactured by Bunshodo Co., Ltd.) to ink for lithographic printing (BSD New Rubber Base: manufactured by Bunshodo Co., Ltd.) to adjust the viscosity of the ink for lithographic printing, having surface tension in the range of 25 to 30 dyn/cm, and having a volume resistivity of approximately $2.3\times10^{11}$ ω·cm. The viscosity of the above-mentioned ink is a value measured using an E-shaped viscosimeter (VISCONIC ED: manufactured by Tokyo Keiki Co., Ltd.) and under measuring conditions of 3°×R7.7 Corn, 0.5 rpm, and 25° C.

On the other hand, an image carrying member so constructed that a dielectric layer 12 having a thickness of 20 μm was formed on the surface of an electrically conductive member 11 composed of an aluminum drum was used as the image carrying member 10.

A dielectric layer 12 composed of polyethylene terephthalate having critical surface tension of 43 dyn/cm and larger than the surface tension of the ink 42, a dielectric layer 12 composed of polyethylene having critical surface tension of 31 dyn/cm and slightly larger than the surface tension of the ink 42, and a dielectric layer 12 composed of an ethylene-tetrafluoroethylene copolymer having critical surface tension of 22 dyn/cm and slightly smaller than the surface tension of the ink 42 were respectively provided in the experimental example 1, the experimental example 2, and the experimental example 3.

Each of the image carrying members 10 provided with the dielectric layers 12 was subjected to discharges using a multi-stylus discharge electrode using a copper line having a thickness of 50 μm as the discharge electrode 2, to form an electrostatic latent having a surface potential of approximately −800 V on the surface of the image carrying member 10.

In applying silicone oil 32 to the surface of each of the image carrying members 10 having the electrostatic latent images thus formed thereon from the application roller 31, silicone oil having a viscosity of 96.6 cP (Silicone Oil SH 200; manufactured by Toray Dow Coning Silicone Co., Ltd.) was used as the silicone oil 32. The silicone oil 32 was applied to the surface of the image carrying member 10 so as to have a thickness of approximately 1 μm.

The above-mentioned ink 42 was held on the surface of the ink carrying member 41 so as to have a thickness of approximately 10 μm, the nip width between the ink carrying member 41 and the image carrying member 10 coated with the silicone oil 32 was so adjusted as to be 1.5 mm, the contact pressure between the ink carrying member 41 and the image carrying member 10 was so adjusted as to be 0.3 kg/cm, and the developing speed was changed in the range of 4 to 80 mm/s, as shown in the following Tables 1 to 3, to bring the ink 42 held on the surface of the ink carrying member 41 into contact with the surface of the image carrying member 10 coated with the silicone oil 32, thereby forming an ink image on the surface of the image carrying member 10.

Each of the ink images formed on the surfaces of the image carrying members 10 as described above was transferred onto the transfer paper 6 by the transfer roller 50 as described above, to evaluate the formed image. The results in the experimental examples 1, 2 and 3 are respectively shown in Table 1, Table 2, and Table 3. The contact pressure between the transfer roller 50 and the image carrying member 10 was set to a line pressure of 1 kg/cm.

In evaluating the image formed on the transfer paper 6, image densities in the image portion and the non-image portion were respectively measured using a reflection densitometer (Sakura Densitometor PDA65), and the difference between the image densities (contrast) in the image portion and the non-image portion was found. As synthetic evaluation, a case where a good image having a contrast of not less than 0.8 and having an image density of less than 0.3 in the non-image portion is obtained was evaluated as ○, a case where an image having a contrast of not less than 0.45 and less than 0.8 and having an image density of less than 0.5 or having a contrast of not less than 0.8 and having an image density of not less than 0.3 and less than 0.5 in the non-image portion, which has no problems in terms of practical applications, is obtained was evaluated as Δ, and a case where an image having a contrast of less than 0.45 or having an image density of not less than 0.5 in the non-image portion, which has problems, is obtained was evaluated by X.

TABLE 1 experimental example 1
critical surface tension of dielectric layer: 43 dyn/cm

| developing speed (mm/s) | density in image portion | density in non-image portion | contrast | synthetic evaluation |
|---|---|---|---|---|
| 4 | 2.15 | 1.58 | 0.57 | X |
| 16 | 2.15 | 0.05 | 2.10 | ○ |
| 38 | 1.91 | 0.06 | 1.85 | ○ |
| 60 | 1.55 | 0.05 | 1.50 | ○ |
| 80 | 0.16 | 0.05 | 0.11 | X |

TABLE 2 experimental example 2
critical surface tension of dielectric layer: 31 dyn/cm

| developing speed (mm/s) | density in image portion | density in non-image portion | contrast | synthetic evaluation |
|---|---|---|---|---|
| 4 | 1.52 | 0.87 | 0.65 | X |
| 16 | 1.46 | 0.06 | 1.40 | ○ |
| 38 | 1.38 | 0.06 | 1.32 | ○ |
| 60 | 1.22 | 0.05 | 1.17 | ○ |
| 80 | 0.08 | 0.04 | 0.04 | X |

TABLE 3

| experimental example 3 critical surface tension of dielectric layer: 22 dyn/cm | | | | |
|---|---|---|---|---|
| developing speed (mm/s) | density in image portion | density in non-image portion | contrast | synthetic evaluation |
| 4 | 0.61 | 0.43 | 0.18 | X |
| 16 | 0.58 | 0.05 | 0.53 | Δ |
| 38 | 0.52 | 0.04 | 0.48 | Δ |
| 60 | 0.43 | 0.03 | 0.40 | X |
| 80 | 0.08 | 0.03 | 0.05 | X |

As apparent from the results, the image density in the image portion is increased as the critical surface tension on the surface of the image carrying member 10 is larger than the surface tension of the ink 42. In the experimental examples 1 and 2 using the image carrying members each having larger critical surface tension on its surface than the surface tension of the ink 42, an image having a higher image density was obtained, as compared with that in the experimental example 3 using the image carrying member 10 having smaller critical surface tension on its surface than the surface tension of the ink 42.

When the developing speed is as low as 4 mm/s, a time period during which the ink 42 held on the surface of the ink carrying member 41 is brought into contact with the surface of the image carrying member 10 was lengthened. In any of the experimental examples 1 to 3, therefore, the ink 42 was supplied to the non-image portion, so that the image density in the non-image portion was increased. Therefore, the formed image was fogged. On the other hand, when the developing speed was as high as 80 mm/s, a time period during which the ink 42 held on the surface of the ink carrying member 41 is brought into contact with the surface of the image carrying member 10 was shortened. Even in any of the experimental examples 1 to 3, therefore, the ink 42 was not sufficiently supplied to the image portion, so that the image density in the image portion was decreased. Therefore, the obtained image does not have a sufficient image density.

This showed that even when the image carrying member 10 having larger critical surface tension on its surface than the surface tension of the ink 42 was used as described above, it was preferable to suitably adjust the developing speed.

Embodiment 2

Figure 2:
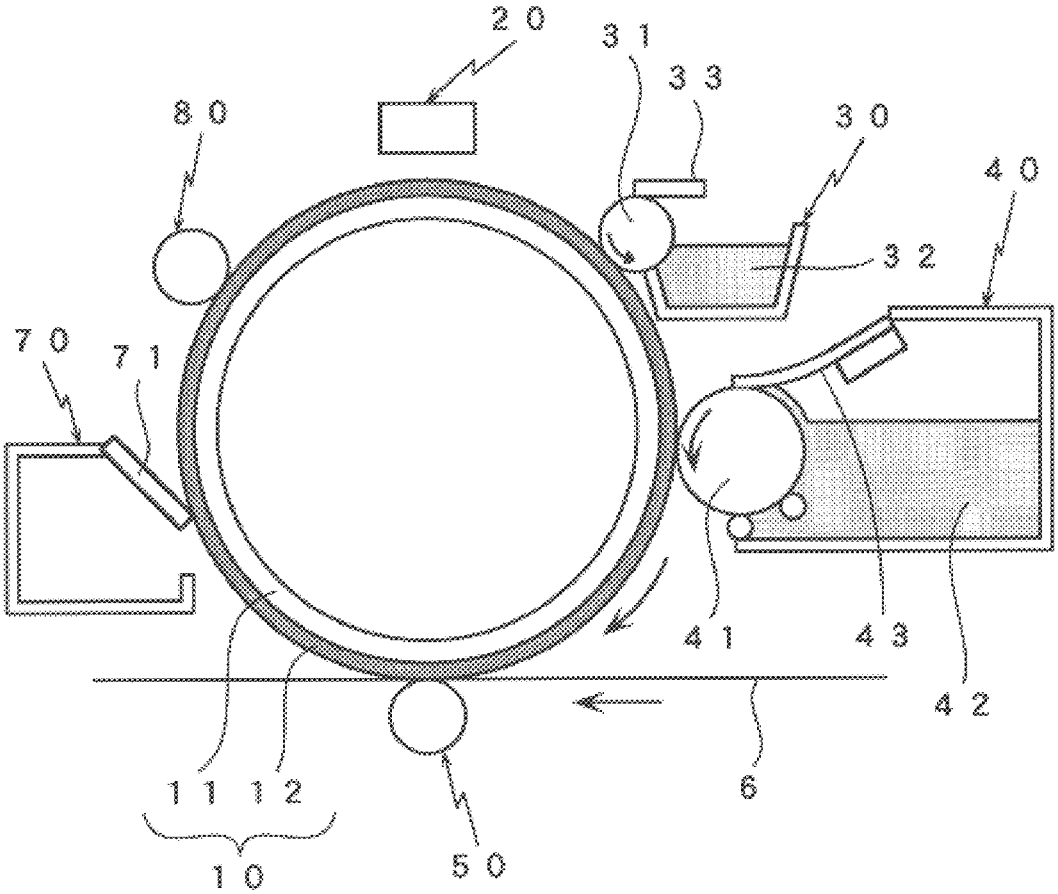
FIG. 2 is a schematic explanatory view of an image forming apparatus according to an embodiment 2 of the present invention.

Also in the present embodiment 2, an image carrying member 10 so constructed that a dielectric layer 12 is formed on the surface of a cylindrical electrically conductive member 11 is used, as shown in FIG. 2.

The image carrying member 10 is rotated at a suitable system speed, to form an electrostatic latent image on the surface of the image carrying member 10 by a latent image forming device 20.

In the present embodiment, as the above-mentioned latent image forming device 20, an electrostatic head 20 of an ion flow type is used. The surface of the image carrying member 10 is selectively charged by the electrostatic head 20, to form an electrostatic latent image.

A non-conductive release agent 32 is then applied to the surface of the image carrying member 10 having the electrostatic latent image thus formed thereon from a release agent application device 30, and ink 42 is brought into contact with the surface of the image carrying member 10 thus coated with the release agent 32 by an ink developing device 40, to perform development.

In the release agent application device 30, silicone oil 32 is used as the release agent 32, a part of an application roller 31 is immersed in the silicone oil 32, to hold the silicone oil 32 on the surface of the application roller 31. The application roller 31 is rotated, and the amount of the silicone oil 32 on the surface of the application roller 31 is regulated by a regulating blade 33. The silicone oil 32 is applied to the surface of the image carrying member 10 having the electrostatic latent image formed thereon so as to have a suitable thickness from the application roller 31. Although another known release agent can be used in addition to the silicone oil as the release agent 32, it is preferable that the silicone oil is used from the viewpoint of facility for handling, for example.

In supplying the ink 42 to the surface of the image carrying member 10 coated with the release agent 32 composed of the silicone oil as described above from the ink developing device 40, the ink 42 is held on the surface of an ink carrying member 41, and the thickness of the ink 42 on the surface of the ink carrying member 41 is regulated by a regulating blade 43 so that the thickness of the ink 42 held on the surface of the ink carrying member 41 is a predetermined thickness. The ink 42 held on the surface of the ink carrying member 41 is brought into contact with the surface of the image carrying member 10, to apply the ink 42 to a portion of the electrostatic latent image formed on the surface of the image carrying member 10.

In the image forming apparatus according to the present embodiment, the system speed of the image carrying member 10 rotated as described above, the type and the thickness of the release agent 32 applied to the surface of the image carrying member 10, the type of the ink 42 used, the nip width from the position where the ink 42 is brought into contact with the surface of the image carrying member 10 coated with the release agent 32 to the position where it is separated therefrom, and the like are suitably adjusted, to control a time period $T_K$ required for the ink 42 to adhere on the surface of the image carrying member 10 having the electrostatic latent image formed thereon through the release agent 32, a time period $T_{NIP}$ elapsed from the time when the ink 42 is brought into contact with the surface of the release agent 32 applied to the image carrying member 10 until it is separated therefrom, and a time period $T_W$ required for the ink 42 to adhere on the surface of the image carrying member 10 having no electrostatic latent image formed thereon through the release agent 32 so that the relationship of $T_W > T_{NIP} > T_K$ is satisfied.

When the ink 42 is brought into contact with the surface of the image carrying member 10 as described above, to form the ink image on the surface of the image carrying member 10, therefore, the ink 42 suitably adheres on a portion of the electrostatic latent image formed on the surface of the image carrying member 10, while the ink 42 is prevented from adhering on a portion having no electrostatic latent image formed thereon, so that an ink image corresponding to the electrostatic latent image is formed on the surface of the image carrying member 10.

After the ink image is thus formed on the surface of the image carrying member 10, the ink image formed on the surface of the image carrying member 10 is transferred onto the transfer paper 6 by a transfer roller 50, as in the above-mentioned embodiment 1.

After the ink image is thus transferred to the transfer paper 6, the ink 42 remaining on the surface of the image carrying member 10 after the transfer is removed from the surface of the image carrying member 10 by a cleaning device 70 using a cleaning blade 71, after which charge remaining on the surface of the image carrying member 10 is eliminated by a charge eliminating device 80. The above-mentioned operations are repeated, to form an image.

Consequently, the ink 42 is suitably supplied only to the portion of the electrostatic latent image formed on the surface of the image carrying member 10 as described above. Therefore, a good image having a sufficient image density and having no voids and fog is obtained.

EXPERIMENTAL EXAMPLE 4

In this experimental example, the system speed of the image carrying member 10 rotated was changed in the image forming apparatus according to the above-mentioned embodiment 2.

In the experimental example, in forming an electrostatic latent image having a potential of −630 V in its part on the surface of the image carrying member 10 by the electrostatic head 20, and applying the non-conductive release agent 32 from the release agent application device 30 to the surface of the image carrying member 10 having the electrostatic latent image thus formed thereon, silicone oil having a viscosity of 2 cP (Silicone Oil SH 200; manufactured by Toray Dow Coning Silicone Co., Ltd.) was used as the release agent 32, and the release agent 32 was applied to the surface of the image carrying member 10 having the electrostatic latent image formed thereon so as to have a thickness of 10 $\mu$m.

In supplying the ink 42 to the image carrying member 10 thus coated with the release agent 32 from the ink developing member 40, used as the ink 42 was one whose viscosity is so adjusted as to be 20000 cP by diluting ink for lithographic printing (manufactured by Best Cure OL SD 797 India Ink IL: T&K TOKA Co., Ltd.) using No. 2 ML Reducer (manufactured by T&K TOKA Co., Ltd.) and No. 2 Contex (manufactured by T&K TOKA Co., Ltd.).

The ink 42 was held on the surface of the ink carrying member 41 such that the thickness thereof was 10 $\mu$m , the ink 42 was brought into contact with the surface of the image carrying member 10 having the electrostatic latent image formed thereon and coated with the release agent 32 as described above such that the contact pressure therebetween was 0.36 kg/mm, and the nip width from the position where the ink 42 is brought into contact with the surface of the image carrying member 10 coated with the release agent 32 to the position where it is separated therefrom was set to 3.5 mm.

The system speed of the image carrying member 10 rotated as described above was changed, to form an image, and the changes in the image density in the image portion having the electrostatic latent image formed thereon and the image density in the non-image portion having no electrostatic latent image formed thereon were examined. The results thereof were shown in FIG. 3.

Figure 3:
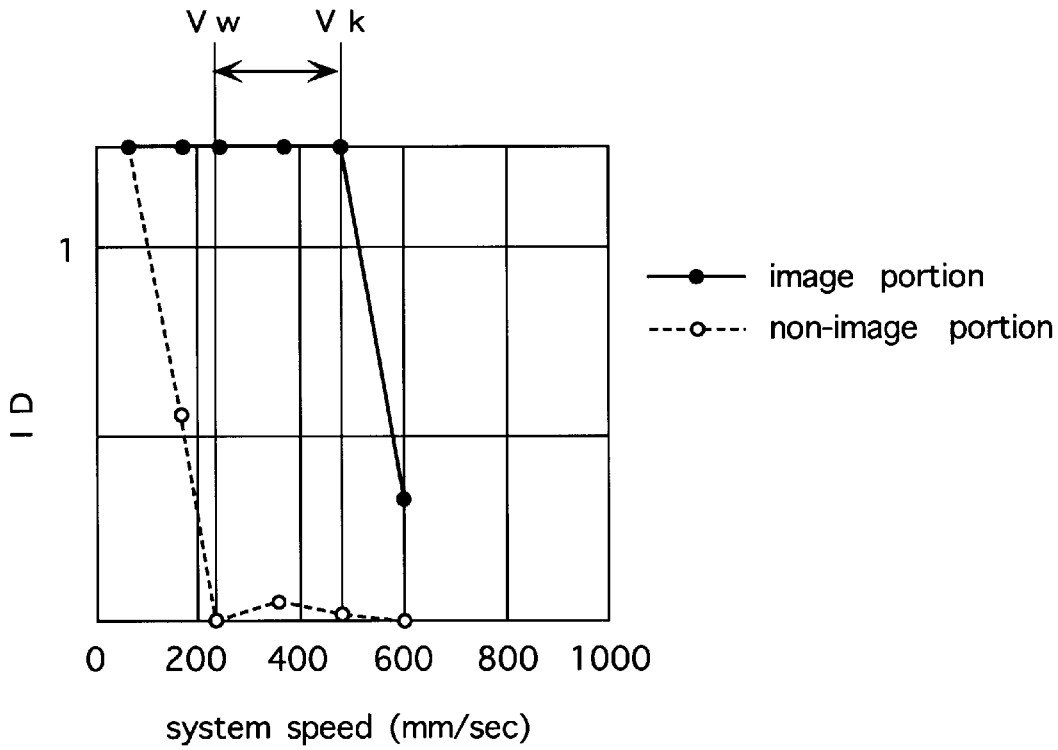
FIG. 3 is a diagram showing such a relationship that an image density in an image portion having an electrostatic latent image formed thereon and an image density in a non-image portion having no electrostatic latent image formed thereon change as the system speed changes in experimental examples using the image forming apparatus according to the embodiment 2.

As a result, in the case of a system speed lower than $V_W$ shown in FIG. 3, the ink 42 also adhered on the non-image portion, so that the formed image was fogged. On the other hand, in the case of a system speed higher than $V_K$, the ink 42 was not sufficiently supplied to the image portion, so that the image density therein was rapidly decreased.

Therefore, the system speed had to be in the range of $V_W$ to $V_K$ in order to obtain a good image which has a sufficient image density in the image portion and is not fogged in the non-image portion.

The values of $V_W$ and $V_K$ in FIG. 3 were approximately 240 mm/s and approximately 480 mm/s, respectively, and the nip width from the position where the ink 42 is brought into contact with the surface of the image carrying member 10 to the position where it is separated therefrom was 3.5 mm. Therefore, a time period $T_K$ required for the ink 42 to adhere on the portion of the electrostatic latent image formed on the surface of the image carrying member 10 was approximately 7.3 ms, and a time period $T_1$, required for the ink 42 to adhere on the portion having no electrostatic latent image formed thereon was approximately 14.6 ms. If a time period $T_{NIP}$ elapsed from the time when the ink 42 is brought into contact with the surface of the image carrying member 10 coated with the release agent 32 until it is separated therefrom is in the range of 7.3 ms to 14.6 ms, a good image having a sufficient image density, and having no voids and fog was obtained.

Figure 4:
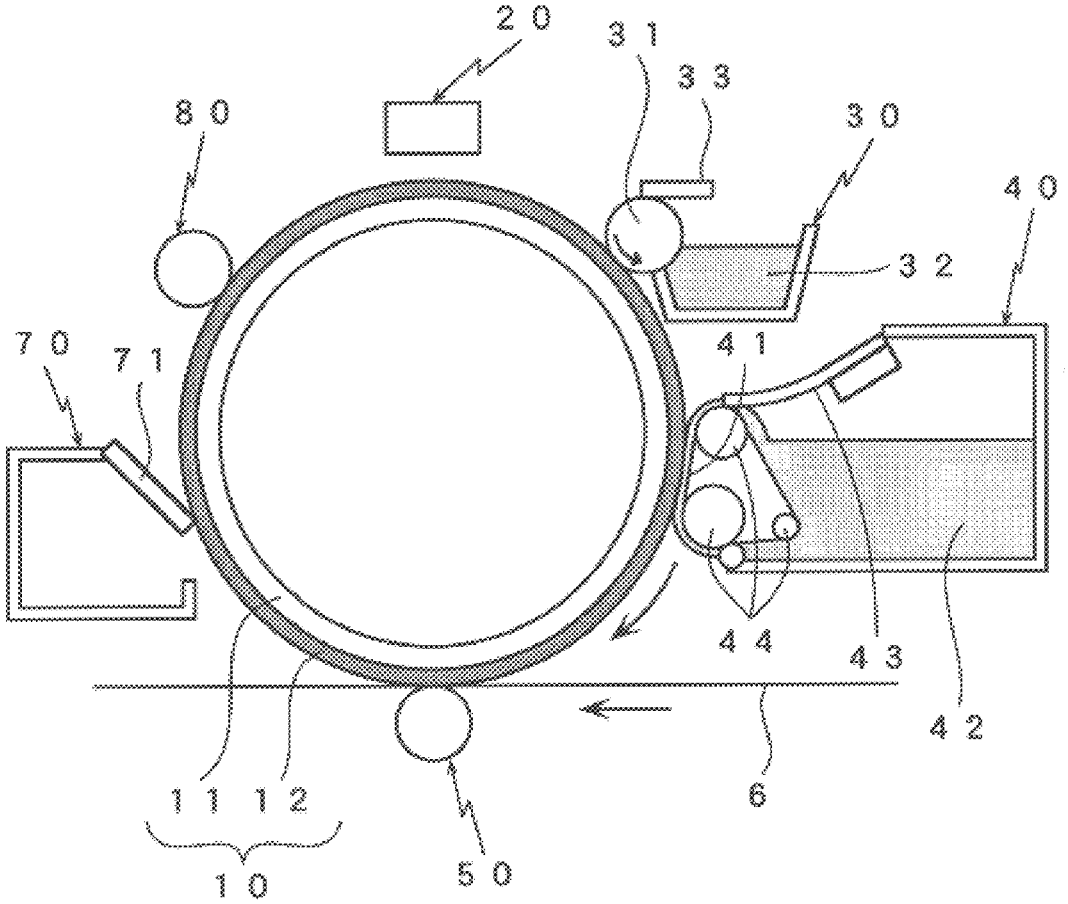
FIG. 4 is a schematic explanatory view of an image forming apparatus according to another embodiment using an ink carrying member in a belt shape.

Although in the image forming apparatus according to the embodiment 2, the ink carrying member 41 in a drum shape was used in the ink developing device 40, an ink carrying member in a belt shape may be used as the ink carrying member 41 in the ink developing device 40. In this case, the ink carrying member 41 in a belt shape can be also stretched among a plurality of rollers 44, as shown in FIG. 4, for example, to lengthen the nip width from the position where the ink 42 held on the ink carrying member 41 is brought into contact with the surface of the image carrying member 10 coated with the release agent 32 until it is separated therefrom.

When the ink carrying member 41 in a belt shape is used, to lengthen the nip width from the position where the ink 42 is brought into contact with the surface of the image carrying member 10 coated with the release agent 32 to the position where it is separated therefrom, a time period $T_{NIP}$ elapsed from the time when the ink 42 is brought into contact with the surface of the image carrying member 10 coated with the release agent 32 until it is separated therefrom is in the above-mentioned range, and the contact pressure at which the ink 42 is brought into contact with the surface of the image carrying member 10 is reduced even in a case where the system speed of the image carrying member 10 rotated is increased, so that an ink image formed on the image carrying member 10 is not distorted. Therefore, a good image is obtained at high speed.

Although in the image forming apparatus according to the embodiment 2, the image carrying member 10 is constructed so that the dielectric layer 12 is formed on the surface of the conductive member 11 was used, a photoreceptor so constructed that a photosensitive layer 13 is formed on the surface of an electrically conductive member 11 can be also used as the image carrying member 10.

Figure 5:
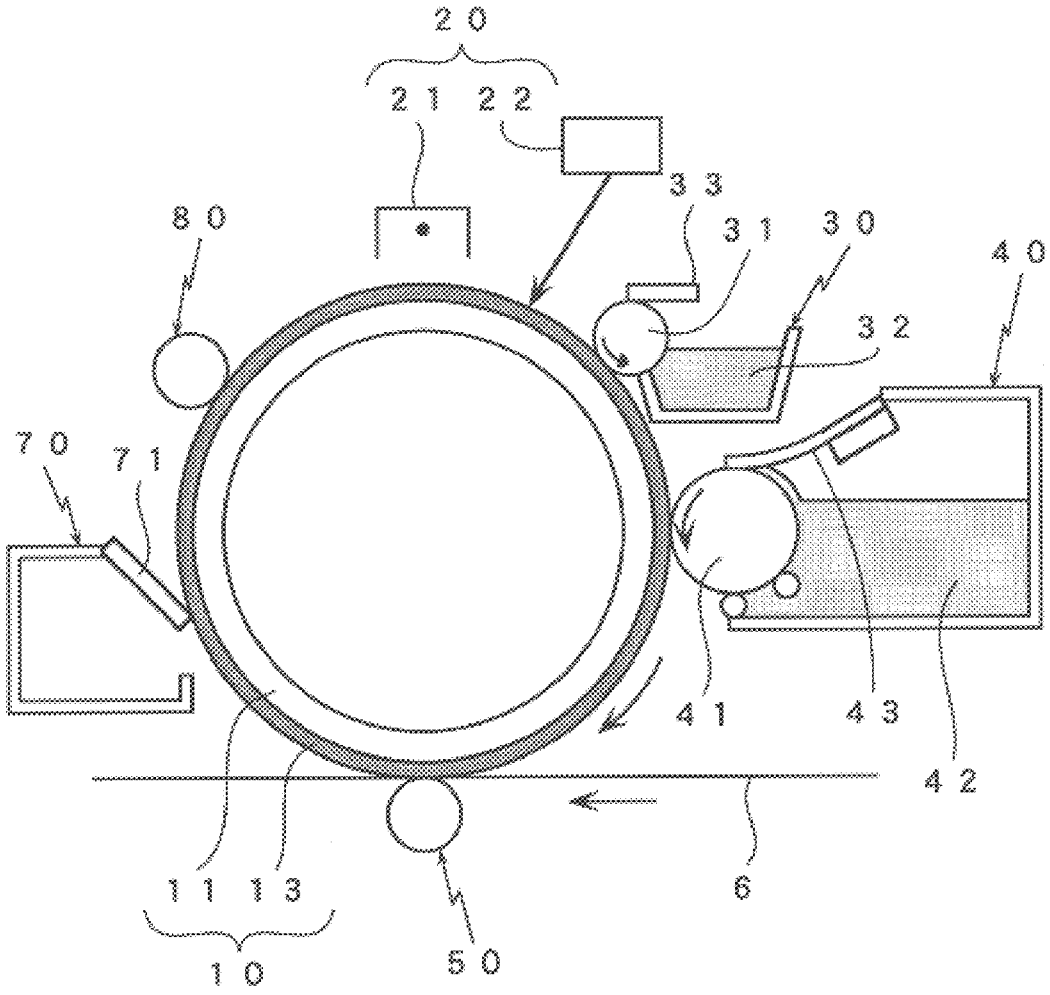
FIG. 5 is a schematic explanatory view of an image forming apparatus according to another embodiment using an image carrying member so constructed that a photosensitive layer is formed on the surface of an electrically conductive member.

In forming an electrostatic latent image on the surface of the image carrying member 10 composed of the photoreceptor by the latent image forming device 20, there are provided a charger 21 for uniformly charging the surface of the image carrying member 10 and an exposing device 22 for exposing the surface of the image carrying member 10 depending on image information as the latent image forming device 20, as shown in FIG. 5. The surface of the image carrying member 10 is uniformly charged by the charger 21, after which the surface of the image carrying member 10 is exposed depending on image information from the exposing device 22, to form an electrostatic latent image on the surface of the image carrying member 10.

It is also possible to increase the nip width by using an image carrying member 10 so constructed that an elastic layer is formed on an electrically conductive member 11, or using an image carrying member 10 using an elastic material as a dielectric material composing a dielectric layer 12. Examples of the elastic material include EPDM (ethylene propylene rubber), NR (natural rubber), SBR (styrene rubber), NBR (nitrile rubber), CR (chloroprene rubber), IIR (butyl rubber), silicone rubber, fluororubber, urethane rubber, etc.

Although the present invention has been fully described by way of examples, it is to be noted that various changes and modification will be apparent to those skilled in the art.

Therefore, unless otherwise such changes and modifications depart from the scope of the present invention, they should be construed as being included therein.

What is claimed is:

1. An image forming apparatus comprising:

an image carrying member having an electrostatic latent image carried on its surface;

an ink developing device comprising an ink carrying member for holding ink, the ink developing device developing the electrostatic latent image formed on said image carrying member by said ink, to form an ink image on the image carrying member; and a transfer device for transferring to a recording medium the ink image formed on the image carrying member, wherein such a relationship that the critical surface tension on the surface of said image carrying member is larger than the surface tension of said ink is satisfied.

2. The image forming apparatus according to claim 1, wherein letting $S_1$ (dyn/cm) be the critical surface tension on the surface of said image carrying member, and $S_2$ (dyn/cm) be the surface tension of said ink, the relationship of $1 \leqq (S_1 - S_2) \leqq 35$ is satisfied.

3. The image forming apparatus according to claim 2, wherein the critical surface tension $S_1$ on the surface of said image carrying member is in the range of 21 to 55 dyn/cm, and the surface tension $S_2$ of said ink is in the range of 20 to 54 dyn/cm.

4. The image forming apparatus according to claim 2, wherein the critical surface tension $S_1$ (dyn/cm) on the surface of said image carrying member and the surface tension $S_2$ (dyn/cm) of the ink satisfy the relationship of $5 \leqq (S_1 - S_2) \leqq 30$.

5. The image forming apparatus according to claim 4, wherein the critical surface tension $S_1$ on the surface of said image carrying member is in the range of 25 to 55 dyn/cm, and the surface tension $S_2$ of said ink is in the range of 20 to 45 dyn/cm.

6. The image forming apparatus according to claim 1, wherein said image carrying member is constructed by forming a dielectric layer on a conductive base substrate.

7. The image forming apparatus according to claim 1, wherein said ink is ink having high electrical resistance which has a volume resistivity of not less than $1 \times 10^8$ ω·cm.

8. The image forming apparatus according to claim 1, further comprising a release agent application device for applying a release agent to the image carrying member.

9. An image forming apparatus comprising:

an image carrying member having an electrostatic latent image carried on its surface;

a release agent application device for applying a release agent to said image carrying member; and an ink developing device comprising an ink carrying member for holding ink, the ink developing device bringing the ink held on the ink carrying member into contact with said image carrying member to form an ink image corresponding to said electrostatic latent image on the image carrying member, wherein the relationship of $TW > T_{NIP} > T_K$ is satisfied, where $T_K$ is a time period required for the ink to adhere on the surface of the image carrying member having the electrostatic latent image formed thereon through the release agent, $T_{NIP}$ is a time period elapsed from the time when the ink is brought into contact with the surface of the release agent on the image carrying member until it is separated therefrom, and $T_W$ is a time period required for the ink to adhere on the surface of the image carrying member having no electrostatic latent image formed thereon through the release agent.

10. The image forming apparatus according to claim 9, wherein said $T_W$, $T_{NIP}$, and $T_K$ satisfy the relationship of $0.9\ T_W \geqq T_{NIP} \geqq 1.1\ T_K$.

11. The image forming apparatus according to claim 10, wherein said $T_W$, $T_{NIP}$ and $T_K$ satisfy the relationship of $0.8\ T_W \geqq T_{NIP} \geqq 1.2\ T_K$.

12. The image forming apparatus according to claim 9, wherein said image carrying member is constructed by forming a dielectric layer on a conductive base substrate.

13. The image forming apparatus according to claim 9, further comprising a transfer device for transferring to a recording medium the ink image formed on the image carrying member.

14. An image forming method comprising the steps of:

forming an electrostatic latent image on an image carrying member;

developing the electrostatic latent image formed on said image carrying member by ink having smaller surface tension than the critical surface tension on the surface of said image carrying member, to form an ink image on the image carrying member; and transferring to a recording medium an ink image formed on said image carrying member.

15. The method according to claim 14, wherein letting $S_1$ (dyn/cm) be the critical surface tension on the surface of said image carrying member, and $S_2$ (dyn/cm) be the surface tension of said ink, the relationship of $1 \leqq (S_1 - S_2) \leqq 35$ is satisfied.

16. The method according to claim 15, wherein the critical surface tension $S_1$ on the surface of said image carrying member is in the range of 21 to 55 dyn/cm, and the surface tension $S_2$ of said ink is in the range of 20 to 54 dyn/cm.

17. The method according to claim 14, further comprising the step of removing the ink remaining on the image carrying member after said transferring step.

18. An image forming method comprising the steps of:

forming an electrostatic latent image on an image carrying member;

applying a release agent to the image carrying member having said electrostatic latent image formed thereon; and making ink adhere on said electrostatic latent image to form an ink image on the image carrying member under conditions satisfying $T_W > T_{NIP} > T_K$, where $T_K$ is a time period required for the ink to adhere on the surface of the image carrying member having the electrostatic latent image formed thereon through the release agent, $T_{NIP}$ is a time period elapsed from the time when the ink is brought into contact with the surface of the release agent on the image carrying member until it is separated therefrom, and $T_W$ is a time period required for the ink to adhere on the surface of the image carrying member having no electrostatic latent image formed thereon through the release agent.

19. The method according to claim 18, wherein said $T_W$, $T_{NIP}$, and $T_K$ satisfy the relationship of $0.9\ T_W \geqq T_{NIP} \geqq 1.1\ T_K$.

20. The image forming apparatus according to claim 19, wherein said $T_W$, $T_{NIP}$, and $T_K$ satisfy the relationship of $0.8\ T_W \geqq T_{NIP} \geqq 1.2\ T_K$.

* * * * *